US009365787B2

(12) United States Patent
Reid et al.

(10) Patent No.: US 9,365,787 B2
(45) **Date of Patent: *Jun. 14, 2016**

(54) DIESEL FUEL COMPOSITIONS

(75) Inventors: Jacqueline Reid, Flintshire (GB); Stephen Leonard Cook, Chester (GB)

(73) Assignee: Innospec Limited (GB)

( * ) Notice: Subject to any disclaimer, the term of this patent is extended or adjusted under 35 U.S.C. 154(b) by 0 days.

This patent is subject to a terminal disclaimer.

(21) Appl. No.: 14/236,754

(22) PCT Filed: Aug. 2, 2012

(86) PCT No.: PCT/GB2012/051881

§ 371 (c)(1), (2), (4) Date: Feb. 24, 2014

(87) PCT Pub. No.: WO2013/017889

PCT Pub. Date: Feb. 7, 2013

(65) Prior Publication Data

US 2014/0174390 A1 Jun. 26, 2014

(30) Foreign Application Priority Data

Aug. 3, 2011 (GB) ..... 1113388.1

(51) Int. Cl.

| | |
|---|---|
| ***C10L 1/22*** | (2006.01) |
| ***C10L 10/04*** | (2006.01) |
| ***C10L 1/14*** | (2006.01) |
| ***C10L 1/238*** | (2006.01) |
| ***C10L 1/2383*** | (2006.01) |
| ***C10L 10/18*** | (2006.01) |
| *C10L 1/16* | (2006.01) |
| *C10L 1/198* | (2006.01) |
| *C10L 1/2387* | (2006.01) |
| *C10L 1/28* | (2006.01) |

(52) U.S. Cl.

CPC ..... *C10L 10/04* (2013.01); *C10L 1/146* (2013.01); *C10L 1/238* (2013.01); *C10L 1/2383* (2013.01); *C10L 10/18* (2013.01); *C10L 1/1616* (2013.01); *C10L 1/198* (2013.01); *C10L 1/2387* (2013.01); *C10L 1/285* (2013.01); *C10L 2270/026* (2013.01)

(58) Field of Classification Search

CPC ... C10L 1/221; C10L 1/2222; C10L 2230/08; C10L 2230/22

USPC ..... 44/422, 347, 348

See application file for complete search history.

(56) References Cited

U.S. PATENT DOCUMENTS

| | | | | |
|---|---|---|---|---|
| 3,018,250 | A | 1/1962 | Anderson et al. | |
| 3,172,892 | A | 3/1965 | Le Suer et al. | |
| 3,361,673 | A | 1/1968 | Stuart et al. | |
| 3,634,515 | A | 1/1972 | Piasek et al. | |
| 5,399,178 | A * | 3/1995 | Cherpeck | 44/415 |
| 5,697,988 | A * | 12/1997 | Malfer et al. | 44/415 |
| 6,299,655 | B1 * | 10/2001 | Steckel et al. | 44/331 |
| 6,733,550 | B1 * | 5/2004 | Grundy et al. | 44/348 |
| 7,906,470 | B2 * | 3/2011 | Stevenson et al. | 508/542 |
| 7,947,093 | B2 * | 5/2011 | Barton et al. | 44/422 |
| 7,951,211 | B2 * | 5/2011 | Barton et al. | 44/422 |
| 8,083,814 | B2 * | 12/2011 | Stevenson et al. | 44/422 |
| 8,147,569 | B2 * | 4/2012 | Barton et al. | 44/422 |
| 8,153,570 | B2 * | 4/2012 | Barton et al. | 508/547 |
| 8,961,623 | B2 * | 2/2015 | Stevenson et al. | 44/422 |
| 2008/0113890 | A1 * | 5/2008 | Moreton et al. | 508/547 |
| 2008/0307698 | A1 | 12/2008 | Barton et al. | |
| 2010/0205852 | A1 * | 8/2010 | Karl et al. | 44/347 |
| 2010/0251603 | A1 * | 10/2010 | Davies et al. | 44/347 |
| 2011/0048354 | A1 | 3/2011 | Hollingshurst | |

(Continued)

FOREIGN PATENT DOCUMENTS

| | | | |
|---|---|---|---|
| EP | 0565285 | A1 | 10/1993 |
| EP | 0831141 | A1 | 3/1998 |
| EP | 1344785 | A1 | 9/2003 |
| GB | 949981 | A1 | 2/1964 |
| WO | 2007015080 | A1 | 2/2007 |
| WO | 2009040583 | A1 | 4/2009 |
| WO | 2010132259 | A1 | 11/2010 |
| WO | 2011141731 | A1 | 11/2011 |

OTHER PUBLICATIONS

International Preliminary Report on Patentability for International Application No. PCT/GB2012/051881 dated Feb. 4, 2014.

*Primary Examiner* — Ellen McAvoy

(74) *Attorney, Agent, or Firm* — Janine M. Susan; Burns & Levinson LLP

(57) ABSTRACT

A diesel fuel composition comprising a quaternary ammonium salt additive which additive is formed by the reaction of (1) a quaternising agent and (2) a compound formed by the reaction of a hydrocarbyl-substituted acylating agent and at least 1.4 molar equivalents of an amine of formula (B1) or (B2), wherein $R^2$ and $R^3$ are the same or different alkyl, alkenyl or aryl groups having from 1 to 22 carbon atoms; X is a bond or alkylene group having from 1 to 20 carbon atoms; n is from 0 to 20; m is from 1 to 5; and R4 is hydrogen or a $C_1$ to $C_{22}$ alkyl group.

(B1)

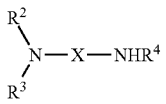

(B2)

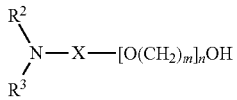

14 Claims, No Drawings

(56) References Cited

U.S. PATENT DOCUMENTS

| | | | | |
|---|---|---|---|---|
| 2011/0143981 | A1 | 6/2011 | Barton et al. | |
| 2012/0010112 | A1* | 1/2012 | Grabarse et al. | 508/291 |
| 2013/0118062 | A1* | 5/2013 | Fang et al. | 44/405 |
| 2013/0239468 | A1* | 9/2013 | Greenfield et al. | 44/419 |
| 2013/0296210 | A1* | 11/2013 | Hansch et al. | 508/547 |
| 2014/0123547 | A1* | 5/2014 | Walter | 44/415 |
| 2014/0238328 | A1* | 8/2014 | Fang | 123/1 A |
| 2014/0318487 | A1* | 10/2014 | Fang et al. | 123/1 A |

* cited by examiner

DIESEL FUEL COMPOSITIONS

CROSS-REFERENCE TO REALTED APPLICATIONS

This application is a U.S. national stage application under 35 U.S.C. 371 of co-pending International Application No. PCT/GB2012/051881 filed on Aug. 2, 2012 and entitled FUEL COMPOSITIONS, which in turn claims priority to Great Britain Patent Application No. 1113388.1, filed on Aug. 3, 2011, which is incorporated by reference herein in its entirety for all purposes.

The present invention relates to fuel compositions and additives thereto. In particular the invention relates to additives for diesel fuel compositions, especially those suitable for use in modern diesel engines with high pressure fuel systems.

Due to consumer demand and legislation, diesel engines have in recent years become much more energy efficient, show improved performance and have reduced emissions.

These improvements in performance and emissions have been brought about by improvements in the combustion process. To achieve the fuel atomisation necessary for this improved combustion, fuel injection equipment has been developed which uses higher injection pressures and reduced fuel injector nozzle hole diameters. The fuel pressure at the injection nozzle is now commonly in excess of 1500 bar ($1.5\times10^8$ Pa). To achieve these pressures the work that must be done on the fuel also increases the temperature of the fuel. These high pressures and temperatures can cause degradation of the fuel.

Diesel engines having high pressure fuel systems can include but are not limited to heavy duty diesel engines and smaller passenger car type diesel engines. Heavy duty diesel engines can include very powerful engines such as the MTU series 4000 diesel having 20 cylinder variants designed primarily for ships and power generation with power output up to 4300 kW or engines such as the Renault dXi 7 having 6 cylinders and a power output around 240 kW. A typical passenger car diesel engine is the Peugeot DW10 having 4 cylinders and power output of 100 kW or less depending on the variant.

In all of the diesel engines relating to this invention, a common feature is a high pressure fuel system. Typically pressures in excess of 1350 bar ($1.35\times10^8$ Pa) are used but often pressures of up to 2000 bar ($2\times10^8$ Pa) or more may exist.

Two non-limiting examples of such high pressure fuel systems are: the common rail injection system, in which the fuel is compressed utilizing a high-pressure pump that supplies it to the fuel injection valves through a common rail; and the unit injection system which integrates the high-pressure pump and fuel injection valve in one assembly, achieving the highest possible injection pressures exceeding 2000 bar ($2\times10^8$ Pa). In both systems, in pressurising the fuel, the fuel gets hot, often to temperatures around 100° C., or above.

In common rail systems, the fuel is stored at high pressure in the central accumulator rail or separate accumulators prior to being delivered to the injectors. Often, some of the heated fuel is returned to the low pressure side of the fuel system or returned to the fuel tank. In unit injection systems the fuel is compressed within the injector in order to generate the high injection pressures. This in turn increases the temperature of the fuel.

In both systems, fuel is present in the injector body prior to injection where it is heated further due to heat from the combustion chamber. The temperature of the fuel at the tip of the injector can be as high as 250-350° C.

Thus the fuel is stressed at pressures from 1350 bar ($1.35\times10^8$ Pa) to over 2000 bar ($2\times10^8$ Pa) and temperatures from around 100° C. to 350° C. prior to injection, sometimes being recirculated back within the fuel system thus increasing the time for which the fuel experiences these conditions.

A common problem with diesel engines is fouling of the injector, particularly the injector body, and the injector nozzle. Fouling may also occur in the fuel filter. Injector nozzle fouling occurs when the nozzle becomes blocked with deposits from the diesel fuel. Fouling of fuel filters may be related to the recirculation of fuel back to the fuel tank. Deposits increase with degradation of the fuel. Deposits may take the form of carbonaceous coke-like residues or sticky or gum-like residues. Diesel fuels become more and more unstable the more they are heated, particularly if heated under pressure. Thus diesel engines having high pressure fuel systems may cause increased fuel degradation.

The problem of injector fouling may occur when using any type of diesel fuels. However, some fuels may be particularly prone to cause fouling or fouling may occur more quickly when these fuels are used. For example, fuels containing biodiesel have been found to produce injector fouling more readily. Diesel fuels containing metallic species may also lead to increased deposits. Metallic species may be deliberately added to a fuel in additive compositions or may be present as contaminant species. Contamination occurs if metallic species from fuel distribution systems, vehicle distribution systems, vehicle fuel systems, other metallic components and lubricating oils become dissolved or dispersed in fuel.

Transition metals in particular cause increased deposits, especially copper and zinc species. These may be typically present at levels from a few ppb (parts per billion) up to 50 ppm, but it is believed that levels likely to cause problems are from 0.1 to 50 ppm, for example 0.1 to 10 ppm.

When injectors become blocked or partially blocked, the delivery of fuel is less efficient and there is poor mixing of the fuel with the air. Over time this leads to a loss in power of the engine, increased exhaust emissions and poor fuel economy.

As the size of the injector nozzle hole is reduced, the relative impact of deposit build up becomes more significant. By simple arithmetic a 5 μm layer of deposit within a 500 μm hole reduces the flow area by 4% whereas the same 5 μm layer of deposit in a 200 μm hole reduces the flow area by 9.8%.

At present, nitrogen-containing detergents may be added to diesel fuel to reduce coking. Typical nitrogen-containing detergents are those formed by the reaction of a polyisobutylene-substituted succinic acid derivative with a polyalkylene polyamine. However, newer engines including finer injector nozzles are more sensitive and current diesel fuels may not be suitable for use with the new engines incorporating these smaller nozzle holes.

The present inventor has developed diesel fuel compositions which when used in diesel engines having high pressure fuel systems provide improved performance compared with diesel fuel compositions of the prior art.

It is advantageous to provide a diesel fuel composition which prevents or reduces the occurrence of deposits in a diesel engine. Such fuel compositions may be considered to perform a "keep clean" function i.e. they prevent or inhibit fouling.

However it would also be desirable to provide a diesel fuel composition which would help clean up deposits that have already formed in an engine, in particular deposits which have formed on the injectors. Such a fuel composition which when combusted in a diesel engine removes deposits therefrom thus effecting the "clean-up" of an already fouled engine.

As with "keep clean" properties, "clean-up" of a fouled engine may provide significant advantages. For example, superior clean up may lead to an increase in power and/or an increase in fuel economy. In addition removal of deposits from an engine, in particular from injectors may lead to an increase in interval time before injector maintenance or replacement is necessary thus reducing maintenance costs.

Although for the reasons mentioned above deposits on injectors is a particular problem found in modern diesel engines with high pressure fuels systems, it is desirable to provide a diesel fuel composition which also provides effective detergency in older traditional diesel engines such that a single fuel supplied at the pumps can be used in engines of all types.

It is also desirable that fuel compositions reduce the fouling of vehicle fuel filters. It would be useful to provide compositions that prevent or inhibit the occurrence of fuel filter deposits i.e, provide a "keep clean" function. It would be useful to provide compositions that remove existing deposits from fuel filter deposits i.e. provide a "clean up" function. Compositions able to provide both of these functions would be especially useful.

According to a first aspect of the present invention there is provided a diesel fuel composition comprising a quaternary ammonium salt additive which additive is formed by the reaction of (1) a quatemising agent and (2) a compound formed by the reaction of a hydrocarbyl-substituted acylating agent and at least 1.4 molar equivalents of an amine of formula (B1) or (B2):

(B1)

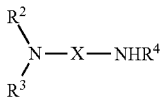

(B2)

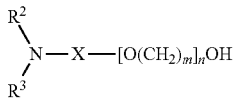

wherein $R^2$ and $R^3$ are the same or different alkyl, alkenyl or aryl groups having from 1 to 22 carbon atoms; X is a bond or alkylene group having from 1 to 20 carbon atoms; n is from 0 to 20; m is from 1 to 5; and $R^4$ is hydrogen or a $C_1$ to $C_{22}$ alkyl group.

The quatemising agent may suitably be selected from esters and non-esters.

In some preferred embodiments, quatemising agents used to form the quaternary ammonium salt additives of the present invention are esters. Preferred ester quatemising agents are compounds of formula $RCOOR^1$ in which R is an optionally substituted alkyl, alkenyl, aryl or alkylaryl group and $R^1$ is a $C_1$ to $C_{22}$ alkyl, aryl or alkylaryl group.

Suitable quatemising agents include esters of carboxylic acids having a $pK_a$ of 3.5 or less.

The compound of formula $RCOOR^1$ is preferably an ester of a carboxylic acid selected from a substituted aromatic carboxylic acid, an α-hydroxycarboxylic acid and a polycarboxylic acid.

In some preferred embodiments the compound of formula $RCOOR^1$ is an ester of a substituted aromatic carboxylic acid and thus R is a substituted aryl group.

Preferably R is a substituted aryl group having 6 to 10 carbon atoms, preferably a phenyl or naphthyl group, most preferably a phenyl group. R is suitably substituted with one or more groups selected from carboalkoxy, nitro, cyano, hydroxy, $SR^5$ or $NR^5R^6$. Each of $R^5$ and $R^6$ may be hydrogen or optionally substituted alkyl, alkenyl, aryl or carboalkoxy groups. Preferably each of $R^5$ and $R^6$ is hydrogen or an optionally substituted $C_1$ to $C_{22}$ alkyl group, preferably hydrogen or a $C_1$ to $C_{16}$ alkyl group, preferably hydrogen or a $C_1$ to $C_{10}$ alkyl group, more preferably hydrogen $C_1$ to $C_4$ alkyl group. Preferably $R^5$ is hydrogen and $R^6$ is hydrogen or a $C_1$ to $C_4$ alkyl group. Most preferably $R^5$ and $R^6$ are both hydrogen. Preferably R is an aryl group substituted with one or more groups selected from hydroxyl, carboalkoxy, nitro, cyano and $NH_2$. R may be a poly-substituted aryl group, for example trihydroxyphenyl. Preferably R is a mono-substituted aryl group. Preferably R is an ortho substituted aryl group. Suitably R is substituted with a group selected from OH, $NH_2$, $NO_2$ or COOMe. Preferably R is substituted with an OH or $NH_2$ group. Suitably R is a hydroxy substituted aryl group. Most preferably R is a 2-hydroxyphenyl group.

Preferably $R^1$ is an alkyl or alkylaryl group. $R^1$ may be a $C_1$ to $C_{16}$ alkyl group, preferably a $C_1$ to $C_{10}$ alkyl group, suitably a $C_1$ to $C_8$ alkyl group. $R^1$ may be $C_1$ to $C_{16}$ alkylaryl group, preferably a $C_1$ to $C_{10}$ alkyl group, suitably a $C_1$ to $C_8$ alkylaryl group. $R^1$ may be methyl, ethyl, propyl, butyl, pentyl, benzyl or an isomer thereof. Preferably $R^1$ is benzyl or methyl. Most preferably $R^1$ is methyl.

An especially preferred compound of formula $RCOOR^1$ is methyl salicylate.

In some embodiments the compound of formula $RCOOR_1$ is an ester of an α-hydroxycarboxylic acid. In such embodiments the compound has the structure:

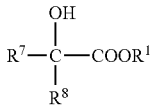

wherein $R^7$ and $R^8$ are the same or different and each is selected from hydrogen, alkyl, alkenyl, aralkyl or aryl. Compounds of this type suitable for use herein are described in EP 1254889.

Examples of compounds of formula $RCOOR^1$ in which RCOO is the residue of an α-hydroxycarboxylic acid include methyl-, ethyl-, propyl-, butyl-, pentyl-, hexyl-, benzyl-, phenyl-, and allyl esters of 2-hydroxyisobutyric acid; methyl-, ethyl-, propyl-, butyl-, pentyl-, hexyl-, benzyl-, phenyl-, and allyl esters of 2-hydroxy-2-methylbutyric acid; methyl-, ethyl-, propyl-, butyl-, pentyl-, hexyl-, benzyl-, phenyl-, and allyl esters of 2-hydroxy-2-ethylbutyric acid; methyl-, ethyl-, propyl-, butyl-, pentyl-, hexyl-, benzyl-, phenyl-, and allyl esters of lactic acid; and methyl-, ethyl-, propyl-, butyl-, pentyl-, hexyl-, allyl-, benzyl-, and phenyl esters of glycolic acid. Of the above, a preferred compound is methyl 2-hydroxyisobutyrate.

In some embodiments the compound of formula $RCOOR^1$ is an ester of a polycarboxylic acid. In this definition we mean to include dicarboxylic acids and carboxylic acids having more than 2 acidic moieties. In such embodiments RCOO is preferably present in the form of an ester, that is the one or more further acid groups present in the group R are in esterified form. Preferred esters are $C_1$ to $C_4$ alkyl esters.

The ester quatemising agent may be selected from the diester of oxalic acid, the diester of phthalic acid, the diester of maleic acid, the diester of malonic acid or the diester of citric acid. One especially preferred compound of formula $RCOOR^1$ is dimethyl oxalate.

In preferred embodiments the compound of formula $RCOOR^1$ is an ester of a carboxylic acid having a pK, of less than 3.5. In such embodiments in which the compound includes more than one acid group, we mean to refer to the first dissociation constant.

The ester quatemising agent may be selected from an ester of a carboxylic acid selected from one or more of oxalic acid, phthalic acid, salicylic acid, maleic acid, malonic acid, citric acid, nitrobenzoic acid, aminobenzoic acid and 2,4,6-trihydroxybenzoic acid.

Preferred ester quatemising agents include dimethyl oxalate, methyl 2-nitrobenzoate and methyl salicylate.

Suitable non-ester quatemising agents include dialkyl sulfates, benzyl halides, hydrocarbyl substituted carbonates, hydrocarbyl substituted epoxides in combination with an acid, alkyl halides, alkyl sulfonates, sultones, hydrocarbyl substituted phosphates, hydrocarbyl substituted borates, alkyl nitrites, alkyl nitrates, hydroxides, N-oxides or mixtures thereof.

In some embodiments the quaternary ammonium salt may be prepared from, for example, an alkyl or benzyl halide (especially a chloride) and then subjected to an ion exchange reaction to provide a different anion as part of the quaternary ammonium salt. Such a method may be suitable to prepare quaternary ammonium hydroxides, alkoxides, nitrites or nitrates.

Preferred non-ester quatemising agents include dialkyl sulfates, benzyl halides, hydrocarbyl substituted carbonates, hydrocarbyl substituted epoxides in combination with an acid, alkyl halides, alkyl sulfonates, sultones, hydrocarbyl substituted phosphates, hydrocarbyl substituted borates, N-oxides or mixtures thereof.

Suitable dialkyl sulfates for use herein as quatemising agents include those including alkyl groups having 1 to 10, preferably 1 to 4 carbons atoms in the alkyl chain. A preferred compound is dimethyl sulfate.

Suitable benzyl halides include chlorides, bromides and iodides. The phenyl group may be optionally substituted, for example with one or more alkyl or alkenyl groups, especially when the chlorides are used. A preferred compound is benzyl bromide.

Suitable hydrocarbyl substituted carbonates may include two hydrocarbyl groups, which may be the same or different. Each hydrocarbyl group may contain from 1 to 50 carbon atoms, preferably from 1 to 20 carbon atoms, more preferably from 1 to 10 carbon atoms, suitably from 1 to 5 carbon atoms. Preferably the or each hydrocarbyl group is an alkyl group. Preferred compounds of this type include diethyl carbonate and dimethyl carbonate.

Suitable hydrocarbyl substituted epoxides have the formula:

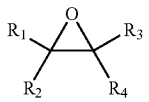

wherein each of $R^1$, $R^2$, $R^3$ and $R^4$ is independently hydrogen or a hydrocarbyl group having 1 to 50 carbon atoms. Examples of suitable epoxides include ethylene oxide, propylene oxide, butylene oxide, styrene oxide and stillbene oxide. The hydrocarbyl epoxides are used as quatemising agents in combination with an acid. In embodiments in which the hydrocarbyl substituted acylating agent is a dicarboxylic acylating agent no separate acid needs to be added. However in other embodiments an acid such as acetic acid may be used.

Especially preferred epoxide quatemising agents are propylene oxide and styrene oxide.

Suitable alkyl halides for use herein include chlorides, bromides and iodides.

Suitable alkyl sulfonates include those having 1 to 20, preferably 1 to 10, more preferably 1 to 4 carbon atoms.

Suitable sultones include propane sultone and butane sultone.

Suitable hydrocarbyl substituted phosphates include dialkyl phosphates, trialkyl phosphates and O,O-dialkyl dithiophosphates. Preferred alkyl groups have 1 to 12 carbon atoms.

Suitable hydrocarbyl substituted borate groups include alkyl borates having 1 to 12 carbon atoms.

Preferred alkyl nitrites and alkyl nitrates have 1 to 12 carbon atoms.

Preferably the non-ester quatemising agent is selected from dialkyl sulfates, benzyl halides, hydrocarbyl substituted carbonates, hydrocarbyl substituted epoxides in combination with an acid, and mixtures thereof.

Especially preferred non-ester quatemising agents for use herein are hydrocarbyl substituted epoxides in combination with an acid. These may include embodiments in which a separate acid is provided or embodiments in which the acid is provided by the tertiary amine compound that is being quatemised. Preferably the acid is provided by the tertiary amine molecule that is being quatemised.

Preferred quatemising agents for use herein include dimethyl oxalate, methyl 2-nitrobenzoate, methyl salicylate and styrene oxide or propylene oxide optionally in combination with an additional acid.

To form the quaternary ammonium salt additives of the present invention the quatemising agent is reacted with a compound (2) formed by the reaction of a hydrocarbyl substituted acylating agent and at least 1.4 molar equivalents of an amine of formula (B1) or (B2).

When a compound of formula (B1) is used, $R^4$ is preferably hydrogen or a $C_1$ to $C_{16}$ alkyl group, preferably a $C_1$ to $C_{10}$alkyl group, more preferably a $C_1$ to $C_6$ alkyl group. When $R^4$ is alkyl it may be straight chained or branched. It may be substituted for example with a hydroxy or alkoxy substituent. Preferably $R^4$ is not a substituted alkyl group. More preferably $R^4$ is selected from hydrogen, methyl, ethyl, propyl, butyl and isomers thereof. Most preferably $R^4$ is hydrogen.

When a compound of formula (B2) is used, m is preferably 2 or 3, most preferably 2; n is preferably from 0 to 15, preferably 0 to 10, more preferably from 0 to 5. Most preferably n is 0 and the compound of formula (B2) is an alcohol.

Preferably the hydrocarbyl substituted acylating agent is reacted with a diamine compound of formula (B1).

$R^2$ and $R^3$ are the same or different alkyl, alkenyl or aryl groups having from 1 to 22 carbon atoms. In some embodiments $R^2$ and $R^3$ may be joined together to form a ring structure, for example a piperidine or imidazole moiety. $R^2$ and $R^3$ may be branched alkyl or alkenyl groups. Each may be substituted, for example with a hydroxy or alkoxy substituent.

Preferably $R^2$ and $R^3$ is each independently a $C_1$ to $C_{16}$ alkyl group, preferably a $C_1$ to $C_{10}$ alkyl group. $R^2$ and $R^3$ may independently be methyl, ethyl, propyl, butyl, pentyl, hexyl, heptyl, octyl, or an isomer of any of these. Preferably $R^2$ and $R^3$ is each independently $C_1$ to $C_4$ alkyl. Preferably $R^2$ is methyl. Preferably $R^3$ is methyl.

X is preferably an alkylene group having 1 to 16 carbon atoms, preferably 1 to 12 carbon atoms, more preferably 1 to 8 carbon atoms, for example 2 to 6 carbon atoms or 2 to 5 carbon atoms. Most preferably X is an ethylene, propylene or butylene group, especially a propylene group.

X is a bond or alkylene group having from 1 to 20 carbon atoms. In preferred embodiments when X alkylene group this group may be straight chained or branched. The alkylene group may include a cyclic structure therein. It may be optionally substituted, for example with a hydroxy or alkoxy substituent.

Examples of compounds of formula (B1) suitable for use herein include 1-aminopiperidine, 1-(2-aminoethyl)piperidine, 1-(3-aminopropyl)-2-pipecoline, 1-methyl-(4-methylamino)piperidine, 4-(1-pyrrolidinyl)piperidine, 1-(2-aminoethyl)pyrrolidine, 2-(2-aminoethyl)-1-methylpyrrolidine, N,N-dlethylethylenediamine, N,N-dimethylethylenediamine, N,N-dibutylethylenediamine, N,N-diethyl-1,3-dlaminopropane, N,N-dimethyl-1,3-dlaminopropane, N,N,N'-trimethylethylenediamine, N,N-dimethyl-N'-ethylethylenediamine, N,N-diethyl-N'-methylethylenediamine, N,N,N'-triethylethylenediamine, 3-dimethylaminopropylamine, 3-diethylaminopropylamine, 3-dibutylaminopropylamine, N,N,N'-trimethyl-1,3-propanediamine, N,N,2,2-tetramethyl-1,3-propanediamine, 2-amino-5-diethylaminopentane, N,N,N',N'-tetraethyldiethylenetriamine, 3,3'-diamino-N-methyldipropylamine, 3,3'-iminobis(N,N-dimethylpropylamine), 1-(3-aminopropyl) imidazole and 4-(3-aminopropyl)morpholine, 1-(2-aminoethyl)piperidine, 3,3-diamino-N-methyldipropylamine, 3,3-aminobis(N,N-dimethy Ipropy lamine), or combinations thereof.

In some preferred embodiments the compound of formula (B1) is selected from N,N-dimethyl-1,3-diaminopropane, N,N-diethyl-1,3-diaminopropane, N,N-dimethylethylenediamine, N,N-dlethylethylenediamine, N,N-dibutylethylenediamine, or combinations thereof.

Examples of compounds of formula (B2) suitable for use herein include alkanolamines including but not limited to triethanolamine, N,N-dimethylaminopropanol, N,N-diethylaminopropanol, N,N-diethylaminobutanol, triisopropanolamine, 1-[2-hydroxyethyl]piperidine, 2-[2-(dimethylamine) ethoxy]-ethanol, N-ethyldiethanolamine, N-methyldiethanolamine, N-butyldiethanolamine, N,N-diethylaminoethanol, N,N-dimethyl amino-ethanol, 2-dimethylamino-2-methyl-1-propanol.

In some preferred embodiments the compound of formula (B2) is selected from Triisopropanolamine, 1-[2-hydroxyethyl]piperidine, 2-[2-(dimethylamine)ethoxy]-ethanol, N-ethyldiethanolamine, N-methyldiethanolamine, N-butyldiethanolamine, N,N-diethylaminoethanol, N,N-dimethylaminoethanol, 2-dimethylamino-2-methyl-1-propanol, or combinations thereof.

Preferably the amine of formula (B1) or (B2) is not N,N-dimethyl-2-ethanolamine or 2-(2-dimethylaminoethoxy) ethanol.

An especially preferred compound of formula (B1) is dimethylaminopropylamine.

The amine of formula (B1) or (B2) is reacted with a hydrocarbyl substituted acylating agent.

The hydrocarbyl substituted acylating agent may be based on a hydrocarbyl substituted di- or polycarboxylic acid or a reactive equivalent thereof. Preferably the hydrocarbyl substituted acylating agent is a hydrocarbyl substituted succinic acid compound such as a succinic acid or succinic anhydride.

The hydrocarbyl substituent preferably comprises at least 10, more preferably at least 12, for example 30 or 50 carbon atoms. It may comprise up to about 200 carbon atoms. Preferably the hydrocarbyl substituent has a number average molecular weight (Mn) of between 170 to 2800, for example from 250 to 1500, preferably from 500 to 1500 and more preferably 500 to 1100. An Mn of 700 to 1300 is especially preferred.

The hydrocarbyl based substituents may be made from homo- or interpolymers (e.g. copolymers, terpolymers) of mono- and di-olefins having 2 to 10 carbon atoms, for example ethylene, propylene, butane-I, isobutene, butadiene, isoprene, 1-hexene, 1-octene, etc. Preferably these olefins are 1-monoolefins. The hydrocarbyl substituent may also be derived from the halogenated (e.g. chlorinated or brominated) analogs of such homo- or interpolymers. Alternatively the substituent may be made from other sources, for example monomeric high molecular weight alkenes (e.g. 1-tetra-contene) and chlorinated analogs and hydrochlorinated analogs thereof, aliphatic petroleum fractions, for example paraffin waxes and cracked and chlorinated analogs and hydrochlorinated analogs thereof, white oils, synthetic alkenes for example produced by the Ziegler-Natta process (e.g. poly (ethylene) greases) and other sources known to those skilled in the art. Any unsaturation in the substituent may if desired be reduced or eliminated by hydrogenation according to procedures known in the art.

The hydrocarbyl group of the hydrocarbyl substituted acylating group may be optionally substituted. It may be substituted along the length of the chain for example with one or more groups selected from hydroxyl, oxygen, halo (especially chloro and fluoro), alkoxy, alkyl mercapto, alkyl sulphoxy, amino or nitro. Alternatively and/or additionally the hydrocarbyl group of the acylating agent may comprise one or more heteroatoms within the main carbon chain. Thus one or more oxygen, nitrogen or sulfur atoms may form part the chain to provide an ether, amine or thioether linkage.

In some embodiments the hydrocarbyl substituted acylating agent may comprise an aromatic moiety. For example the hydrocarbyl substituted acylating agent may be a substituted phthalic anhydride, for example a polyisobutylene substituted phthalic anhydride.

The term "hydrocarbyl" as used herein preferably denotes a group having a carbon atom directly attached to the remainder of the molecule and having a predominantly aliphatic hydrocarbon character. Suitable hydrocarbyl based groups may contain non-hydrocarbon moieties. For example they may contain up to one non-hydrocarbyl group for every ten carbon atoms provided this non-hydrocarbyl group does not significantly alter the predominantly hydrocarbon character of the group. Those skilled in the art will be aware of such groups, which include for example hydroxyl, oxygen, halo (especially chloro and fluoro), alkoxyl, alkyl mercapto, alkyl sulphoxy, etc. Preferred hydrocarbyl based substituents are purely aliphatic hydrocarbon in character and do not contain such groups.

The hydrocarbyl-based substituents are preferably predominantly saturated, that is, they contain no more than one carbon-to-carbon unsaturated bond for every ten carbon-to-carbon single bonds present. Most preferably they contain no more than one carbon-to-carbon unsaturated bond for every 50 carbon-to-carbon bonds present.

Preferred hydrocarbyl-based substituents are poly-(isobutene)s known in the art. Thus in especially preferred embodiments the hydrocarbyl substituted acylating agent is a polyisobutenyl substituted succinic anhydride.

The preparation of polyisobutenyl substituted succinic anhydrides (PIBSA) is documented in the art. Suitable processes include thermally reacting polyisobutenes with maleic anhydride (see for example U.S. Pat. Nos. 3,361,673 and 3,018,250), and reacting a halogenated, in particular a chlorinated, polyisobutene (PIB) with maleic anhydride (see for example U.S. Pat. No. 3,172,892). Alternatively, the polyisobutenyl succinic anhydride can be prepared by mixing the polyolefin with maleic anhydride and passing chlorine through the mixture (see for example GB-A-949,981).

Conventional polyisobutenes and so-called "highly-reactive" polyisobutenes are suitable for use in preparing additive (i) of the present invention. Highly reactive polyisobutenes in this context are defined as polyisobutenes wherein at least 50%, preferably 70% or more, of the terminal olefinic double bonds are of the vinylidene type as described in EP0565285. Particularly preferred polyisobutenes are those having more than 80 mol % and up to 100% of terminal vinylidene groups such as those described in EP1344785.

Other preferred hydrocarbyl groups include those having an internal olefin for example as described in the applicant's published application WO2007/015080.

An internal olefin as used herein means any olefin containing predominantly a non-alpha double bond, that is a beta or higher olefin. Preferably such materials are substantially completely beta or higher olefins, for example containing less than 10% by weight alpha olefin, more preferably less than 5% by weight or less than 2% by weight. Typical internal olefins include Neodene 151810 available from Shell.

Internal olefins are sometimes known as isomerised olefins and can be prepared from alpha olefins by a process of isomerisation known in the art, or are available from other sources. The fact that they are also known as internal olefins reflects that they do not necessarily have to be prepared by isomerisation.

Some preferred acylating agents for use in the preparation of the quaternary ammonium salt additives of the present invention are polyisobutene-substituted succinic acids or succinic anhydrides. When a compound of formula (B2) is reacted with a succinic acylating agent the resulting product is a succinic ester. When a succinic acylating agent is reacted with a compound of formula (B1) in which $R^4$ is hydrogen the resulting product may be a succinimide or a succinamide. When a succinic acylating agent is reacted with a compound of formula (B1) in which $R^4$ is not hydrogen the resulting product is an amide.

In the formation of compound (2) which is reacted with a quaternising agent (1) to form the quaternary ammonium salt additives of the present invention, the hydrocarbyl substituted acylating agent is reacted with at least 1.4 molar equivalents of an amine of formula (B1) or (B2). In some embodiments a mixture of amines of formula (B1) and/or (B2) may be used and any references to such amines includes mixtures.

In preferred embodiments compound (2) is prepared by reacting the hydrocarbyl substituted acylating agent with at least 1.5 molar equivalents of an amine of formula (B1) or (B2), preferably at least 1.6 molar equivalents, more preferably at least 1.7 molar equivalents. Compound (2) is suitably prepared by reacting an amine of formula (B1) or (B2) and the hydrocarbyl substituted acylating agent in a molar ratio of at least 1.75:1 (amine:acylating agent), preferably at least 1.8:1, more preferably at least 1.9:1, for example at least 1.95:1.

Compound (2) is suitably prepared by reacting an amine of formula (B1) or (B2) and the hydrocarbyl substituted acylating agent in a molar ratio of up to 20:1 (amine:acylating agent), preferably up to 10:1, more preferably up to 5:1, for example up to 3:1.

Compound (2) is suitably prepared by reacting an amine of formula (B1) or (B2) and the hydrocarbyl substituted acylating agent in a molar ratio of up to 2.5:1 (amine:acylating agent), preferably up to 2.3:1, more preferably up to 2.2:1, for example up to 2.1:1.

Compound (2) is suitably prepared by reacting an amine of formula (B1) or (B2) and the hydrocarbyl substituted acylating agent in a molar ratio of approximately 2:1 (amine:acylating agent).

Compound (2) thus suitably comprises 1.7 to 2.3, preferably 1.9 to 2.1, preferably approximately 2 tertiary amine centres per molecule. To form such a compound each molecule of the hydrocarbyl substituted acylating agent is suitably reacted with two amines of formula (B1) or (B2).

The hydrocarbyl substituted acylating agent used to prepare compound (2) thus preferably comprises at least 1.4 acylating groups per molecule, preferably at least 1.5 acylating groups per molecule, more preferably at least 1.6 acylating groups per molecule, suitably at least 1.7 acylating groups per molecule, preferably at least 1.8 acylating groups per molecule, more preferably at least 1.9 acylating groups per molecule, for example at least 2 acylating groups per molecule. It will be appreciated that any given molecule cannot include for example 1.8 acylating groups but the skilled person will appreciate that the molecules used may comprise complex mixtures and the above amounts refer to the average number of acylating groups per molecule.

Preferred acylating groups are carboxylic add groups or reactive equivalents thereof. The hydrocarbyl substituted acylating agent preferably comprises at least two carboxylic acid groups per molecule. Some preferred acylating agents for use herein are polycarboxylic acids.

In some embodiments the hydrocarbyl substituted acylating agent may comprise a diacid moiety wherein each acid group is able to react with an amine of formula (B1) or (B2) to provide diester or a diamide having two tertiary amine centres. An example of such a hydrocarbyl substituted acylating agent is a hydrocarbyl substituted succinic acid. If reacted with an amine of formula (B1) the resulting diamides will have the structure shown in figure (C1) below. If reacted with an amine of formula (B2) the resulting diesters would have the structure shown in figure (C2) below. It would also be possible to form a half-amide half-ester compound as shown in figure (C3) below, by reacting the diacid with one molar equivalent of an amine of formula (B1) and one molar equivalent of an amine of formula (B2). It would also be possible to form a compound in which the groups NR'R' and OR' were shown the other way round in figure (C3). In fact, as the skilled person would appreciate, it is likely that such a compound would comprise a mixture of isomers (and small amounts of the compounds of formula (C1) and (C2)). The skilled person would also appreciate that mixtures of compounds of formula (C1), compounds of formula (C2) and compounds of formula (C3) and isomers thereof could be prepared if the diacid is reacted with a mixture of an amine of formula (B1) and an amine of formula (B2) whether in a 1:1 ratio or otherwise.

(C1)

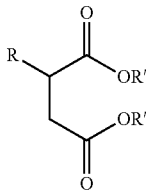

-continued (C2)

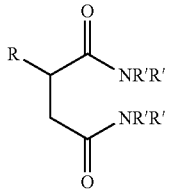

(C3)

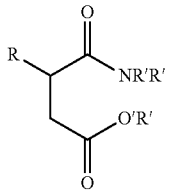

In the structures (C1), (C2) and (C3) above each R is an optionally substituted hydrocarbyl group, preferably a polyisobutylene moiety and each R' may be the same or different. Thus in the compound (C2) there may be one, two, three or four different R' groups.

Other diacids which may be reacted with compounds of formula (B1) or (B2) include dimers of fatty acids, for example the compound shown below in which each of n, m, o and p is 0 to 20:

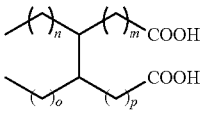

In some embodiments, for example in the case of succinic acid, two acylating groups present in the hydrocarbyl substituted acylating agent may be part of the same acylating group species. By this we mean that the two acylating groups are in close proximity and are introduced into the hydrocarbyl substituted acylating agent as part of the same moiety.

In some embodiments the hydrocarbyl substituted acylating agent may comprise two or more separate acylating groups species. These may include two or more monocarboxylic acid moities. The molecule may include monocarboxylic acid moieties and/or dicarboxylic acid moieties and/or tricarboxylic acid moieties. In some embodiments the hydrocarbyl substituted acylating agent may comprise two or more dicarboxylic acid moieties, for example two succinic acid groups. When two succinic acid groups are present these may suitably be spaced along the hydrocarbyl group. The resulting tertiary amine compounds (2) may be esters, amides or succinimides, represented for example by the structures shown in figures (D1), (D2), (D3) or (D4) below:

(D1)

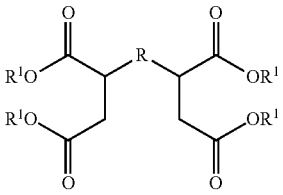

-continued (D2)

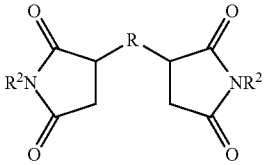

(D3)

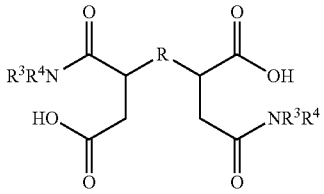

(D4)

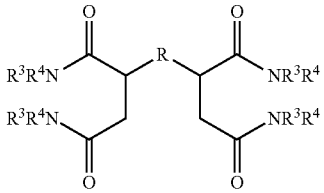

In figure (D1) above at least two of the groups $OR^1$ are the residues of compounds of formula (B2), the other two groups $OR^1$ may each independently be OH or the residue of a compound of formula (B2).

In figure (D2) above the groups $NR^2$ are the residues of compounds of formula (B1) in which $R^4$ is hydrogen. Each group $R^2$ may be the same or different.

The structure shown in figure (D3) above is merely illustrative of a diamide compound including two groups $NR^3R^4$ which are the residues of compounds of formula (B1) and two OH groups. However the positions of these groups are interchangeable.

The groups $NR^3R^4$ shown in figure (D4) are the residues of compounds of formula (B1). It is also possible to form a compound intermediate between that shown in (D3) and (D4) which includes one OH residue and three groups $NR^3R^4$.

In the structures (D3) and (D4) above each group $R^3$ may be the same or different; each group $R^4$ may be the same or different; and the groups $R^3$ and $R^4$ may be the same or different to each other.

In the compounds illustrated in figures (D1), (D2), (D3) and (D4) above R is an optionally substituted hydrocarbyl group. It may be optionally substituted along the chain or within the chain. R may be branched.

In some embodiments the hydrocarbyl substituted acylating agent may include two dicarboxylic acid groups linked via the acid groups using a linker moiety. The linker moiety may be selected from any compound comprising two functional groups able to react with a carboxylic acid. Examples of compounds (2) linked in such a way comprising two succinic acid groups are shown in figures (E1), (E2) and (E3) below. Linker moiety L is an optionally substituted alkylene or arylene chain and each X is independently NH or O; each $R^1$ may be the same or different; each $R^2$ may be the same or different; and each $R^3$ will be the same or different. The skilled person will appreciate that the structures shown below are merely illustrative and that mixtures of compounds including isomers that are not shown may typically be present. Preferred linker moieties L include poly(oxyalkylene) groups, for example poly(oxyethylene) groups.

(E1)

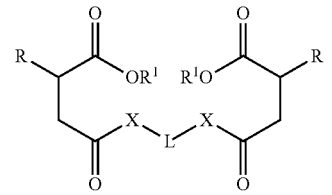

(E2)

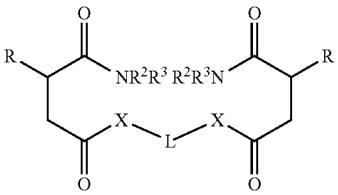

(E3)

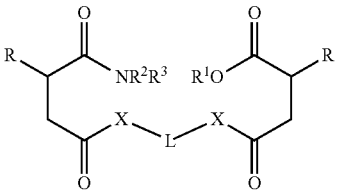

In some preferred embodiments the hydrocarbyl substituted acylating agent comprises two carboxylic acid groups spaced by at least three carbon atoms between the carbon atoms which form part of the acid group (and not including those atoms themselves). In succinic acid, for example there are two carbon atoms between the carbon atoms which form part of the acid group. In such embodiments the molecule may comprise more than two carboxylic acid groups.

The quaternary ammonium salt additives of the present invention may be prepared by any suitable method. Such methods will be known to the person skilled in the art and are exemplified herein. Typically the quaternary ammonium salt additives will be prepared by heating the quatemising agent and a compound prepared by the reaction of a hydrocarbyl substituted acylating agent with an amine of formula (B1) or (B2), optionally in the presence of a solvent. The resulting crude reaction mixture may be added directly to a diesel fuel, optionally following removal of solvent. Any by-products or residual starting materials still present in the mixture have not been found to cause any detriment to the performance of the additive. When preparing the quaternary ammonium salts of the present invention the molar ratio of the quatemising agent (1) to compound (2) will typically be at least 1.4:1, preferably at least 1.5:1, suitably at least 1.6:1, preferably at least 1.7:1, suitably from 1.9:1 to 2:1, for example about 2:1. Thus to form the quaternary ammonium salt additive approximately one molar equivalent of the quatemising agent (1) will be used for each tertiary amine group present in compound (2).

Some preferred quaternary ammonium salts of the present invention are the reaction product of a polyisobutenyl succinic acylating agent with dimethylaminopropylamine (N,N dimethyl 1,3 propane diamine) which is quatemised using propylene oxide, styrene oxide or methyl salicylate.

The composition of the present invention may further comprise a second additive which is the product of a Mannich reaction between:

(a) an aldehyde;

(b) an amine; and (c) an optionally substituted phenol.

Any aldehyde may be used as aldehyde component (a) of the Mannich additive. Preferably the aldehyde component (a) is an aliphatic aldehyde. Preferably the aldehyde has 1 to 10 carbon atoms, preferably 1 to 6 carbon atoms, more preferably 1 to 3 carbon atoms. Most preferably the aldehyde is formaldehyde.

Amine component (b) of the Mannich additive may be at least one amino or polyamino compound having at least one NH group. Suitable amino compounds include primary or secondary monoamines having hydrocarbon substituents of 1 to 30 carbon atoms or hydroxyl-substituted hydrocarbon substituents of 1 to about 30 carbon atoms.

In preferred embodiments the amine component (b) is a polyamine.

Polyamines may be selected from any compound including two or more amine groups. Preferably the polyamine is a (poly)alkylene polyamine (by which is meant an alkylene polyamine or a polyalkylene polyamine; including in each case a diamine, within the meaning of "polyamine"). Preferably the polyamine is a (poly)alkylene polyamine in which the alkylene component has 1 to 6, preferably 1 to 4, most preferably 2 to 3 carbon atoms. Most preferably the polyamine is a (poly) ethylene polyamine (that is, an ethylene polyamine or a polyethylene polyamine).

Preferably the polyamine has 2 to 15 nitrogen atoms, preferably 2 to 10 nitrogen atoms, more preferably 2 to 8 nitrogen atoms.

Preferably the polyamine component (b) includes the moiety $R^1R^2NCHR^3CHR^4NR^5R^6$ wherein each of $R^1$, $R^2R^3$, $R^4$, $R^5$ and $R^6$ is independently selected from hydrogen, and an optionally substituted alkyl, alkenyl, alkynyl, aryl, alkylaryl or arylalkyl substituent.

Thus the polyamine reactants used to make the Mannich reaction products of the present invention preferably include an optionally substituted ethylene diamine residue.

Preferably at least one of $R^1$ and $R^2$ is hydrogen. Preferably both of $R^1$ and $R^2$ are hydrogen.

Preferably at least two of $R^1$, $R^2$, $R^5$ and $R^6$ are hydrogen.

Preferably at least one of $R^3$ and $R^4$ is hydrogen. In some preferred embodiments each of $R^3$ and $R^4$ is hydrogen. In some embodiments $R^3$ is hydrogen and $R^4$ is alkyl, for example $C_1$ to $C_4$ alkyl, especially methyl.

Preferably at least one of $R^5$ and $R^6$ is an optionally substituted alkyl, alkenyl, alkynyl, aryl, alkylaryl or arylalkyl substituent.

In embodiments in which at least one of $R^1$, $R^2$, $R^3$, $R^4$, $R^5$ and $R^6$ is not hydrogen, each is independently selected from an optionally substituted alkyl, alkenyl, alkynyl, aryl, alkylaryl or arylalkyl moiety. Preferably each is independently selected from hydrogen and an optionally substituted C(1-6) alkyl moiety.

In particularly preferred compounds each of $R^1$, $R^2$, $R^3$, $R^4$ and $R^5$ is hydrogen and $R^6$ is an optionally substituted alkyl, alkenyl, alkynyl, aryl, alkylaryl or arylalkyl substituent. Preferably $R^6$ is an optionally substituted C(1-6)alkyl moiety.

Such an alkyl moiety may be substituted with one or more groups selected from hydroxyl, amino (especially unsubstituted amino; —NH—, —$NH_2$), sulpho, sulphoxy, C(1-4) alkoxy, nitro, halo (especially chloro or fluoro) and mercapto.

There may be one or more heteroatoms incorporated into the alkyl chain, for example O, N or S, to provide an ether, amine or thioether.

Especially preferred substituents $R^1$, $R^2$, $R^3$, $R^4$, $R^5$ or $R^6$ are hydroxy-C(1-4)alkyl and amino-(C(1-4)alkyl, especially HO—$CH_2$—$CH_2$— and $H_2N$—$CH_2$—$CH_2$.

Suitably the polyamine includes only amine functionality, or amine and alcohol functionalities.

The polyamine may, for example, be selected from ethylenediamine, diethylenetriamine, triethylenetetramine, tetraethylenepentamine, pentamethylene-hexamine, hexaethyleneheptamine, heptaethyleneoctamine, propane-1,2-diamine, 2(2-amino-ethylamino)ethanol, and N,N-bis(2-aminoethyl)ethylenediamine ($N(CH_2CH_2NH_2)_3$). Most preferably the polyamine comprises tetraethylenepentamine or ethylenediamine.

Commercially available sources of polyamines typically contain mixtures of isomers and/or oligomers, and products prepared from these commercially available mixtures fall within the scope of the present invention.

The polyamines used to form the Mannich additives of the present invention may be straight chained or branched, and may include cyclic structures.

Phenol component (c) used to prepare the Mannich additives of the present invention may be substituted with 1 to 4 groups on the aromatic ring (in addition to the phenol OH). For example it may be a tri- or di-substituted phenol. Most preferably component (c) is a mono-substituted phenol. Substitution may be at the ortho, and/or meta, and/or para position(s).

Each phenol moiety may be ortho, meta or para substituted with the aldehyde/amine residue. Compounds in which the aldehyde residue is ortho or para substituted are most commonly formed. Mixtures of compounds may result. In preferred embodiments the starting phenol is para substituted and thus the ortho substituted product results.

The phenol may be substituted with any common group, for example one or more of an alkyl group, an alkenyl group, an alkynl group, a nitryl group, a carboxylic acid, an ester, an ether, an alkoxy group, a halo group, a further hydroxyl group, a mercapto group, an alkyl mercapto group, an alkyl sulphoxy group, a sulphoxy group, an aryl group, an arylalkyl group, a substituted or unsubstituted amine group or a nitro group.

In some preferred embodiments the phenol is substituted with at least one branched hydrocarbyl group having a molecular weight of between 200 and 3000.

The hydrocarbyl substituent may be optionally substituted with, for example, hydroxyl, halo, (especially chloro and fluoro), alkoxy, alkyl, mercapto, alkyl sulphoxy, aryl or amino residues. Preferably the hydro carbyl group consists essentially of carbon and hydrogen atoms. The substituted phenol may include an alkenyl or alkynyl residue including one or more double and/or triple bonds.

The hydrocarbyl-based substituents are preferably predominantly saturated, that is, they contain no more than one carbon-to-carbon unsaturated bond for every ten carbon-to-carbon single bonds present. Most preferably they contain no more than one carbon-to-carbon unsaturated bond for every 50 carbon-to-carbon bonds present.

Preferably component (c) is a monoalkyl phenol, especially a para-substituted monoalkyl phenol in which the alkyl chain of the substituent is branched.

In preferred embodiments phenol component (c) used to prepare Mannich reaction product additive includes a predominantly or completely saturated branched hydrocarbyl substituent. Preferably this predominantly or completely saturated hydrocarbyl substituent is branched along the length of the chain. By branched along the length of the chain we mean that there are multiple branches from the main (or longest) chain. Preferably there is a branch at least every 10 carbon atoms along the main chain, preferably at least every 6 carbons, suitably at least every 4 carbons, for example every 3 carbon atoms or every 2 carbon atoms.

A particular carbon atom in the main hydrocarbyl chain (which is preferably an alkylene chain) may have one or two branching hydrocarbyl groups. By branching hydrocarbyl groups we mean hydrocarbyl groups not forming part of the main chain but directly attached thereto. Thus the main hydrocarbyl chain may include the moiety —$CHR^1$— or —$CR^1R^2$— wherein $R^1$ and $R^2$ are branching hydrocarbyl groups.

Preferably each branching hydrocarbyl group is an alkyl group, preferably a $C_1$ to $C_4$ alkyl group, for example propyl, ethyl or most preferably methyl.

In some preferred embodiments phenol component (c) used to prepare Mannich reaction product additive (ii) includes a hydrocarbyl substituent which is substituted with methyl groups along the main chain thereof. Suitably there are a plurality of carbon atoms which each have two methyl substituents.

Preferably the branching points are substantially equally spaced along the main chain of the hydrocarbyl group of phenol component (c).

Component (c) used to prepare additive (ii) includes at least one branched hydrocarbyl substituent. Preferably this is an alkyl substituent. In especially preferred embodiments the hydrocarbyl substituent is derived from a polyalkene, suitably a polymer of a branched alkene, for example polyisobutene or polypropene.

In especially preferred embodiments component (c) used in the preparation of Mannich reaction product additive (ii) includes a poly(isobutene) derived substituent.

Thus the Mannich reaction product additives (ii) used in the present invention preferably include a hydrocarbyl chain having the repeating unit:

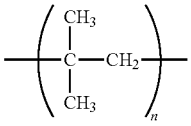

Poly(isobutenes) are prepared by the addition polymerisation of isobutene, $(CH_3)_2C{=}CH_2$. Each molecule of the resulting polymer will include a single alkene moiety.

Conventional polyisobutenes and so-called "highly-reactive" polyisobutenes are suitable for use in preparing additive (i) of the present invention. Highly reactive polyisobutenes in this context are defined as polyisobutenes wherein at least 50%, preferably 70% or more, of the terminal olefinic double bonds are of the vinylidene type as described in EP0565285. Particularly preferred polyisobutenes are those having more than 80 mol % and up to 100% of terminal vinylidene groups such as those described in EP1344785.

Other methods of preparing polyalkylene substituted phenols, for example polyisobutene substituted phenols are known to the person skilled in the art, and include the methods described in EP831141.

In some preferred embodiments the hydrocarbyl substituent of component (c) has an average molecular weight of 200 to 3000. Preferably it has a molecular weight of at least 225, suitably at least 250, preferably at least 275, suitably at least 300, for example at least 325 or at least 350. In some embodiments the hydrocarbyl substituent of component (c) has an average molecular weight of at least 375, preferably at least 400, suitably at least 475, for example at least 500.

In some embodiments component (c) may include a hydrocarbyl substituent having an average molecular weight of up to 2800, preferably up to 2600, for example up to 2500 or up to 2400.

In some embodiments the hydrocarbyl substituent of component (c) has an average molecular weight of from 400 to 2500, for example from 450 to 2400, preferably from 500 to 1500, suitably from 550 to 1300.

In some embodiments the hydrocarbyl substituent of component (c) has an average molecular weight of from 200 to 600.

In some embodiments the hydrocarbyl substituent of component (c) has an average molecular weight of from 500 to 1000.

In some embodiments the hydrocarbyl substituent of component (c) has an average molecular weight of from 700 to 1300.

In some embodiments the hydrocarbyl substituent of component (c) has an average molecular weight of from 1000 to 2000.

In some embodiments the hydrocarbyl substituent of component (c) has an average molecular weight of from 1700 to 2600, for example 2000 to 2500.

In some preferred embodiments the or each substituent of the phenol component (c) has an average molecular weight of less than 400.

In such embodiments the or each substituent of phenol component (c) has a molecular weight of less than 350, preferably less than 300, more preferably less than 250 and most preferably less than 200. The or each substituent of phenol component (c) may suitably have a molecular weight of from 100 to 250, for example 150 to 200.

Molecules of component (c) may have a molecular weight on average of less than 1800, preferably less than 800, preferably less than 500, more preferably less than 450, preferably less than 400, preferably less than 350, more preferably less than 325, preferably less than 300 and most preferably less than 275.

In some embodiments the or each alkyl substituent of component (c) has from 4 to 20 carbons atoms, preferably 6 to 18, more preferably 8 to 16, especially 10 to 14 carbon atoms. In a particularly preferred embodiment, component (c) is a phenol having a C12 alkyl substituent.

Unless otherwise mentioned all average molecular weights referred to herein are number average molecular weights.

Components (a), (b) and (c) used to prepare the Mannich product additives (ii) may each comprise a mixture of compounds and/or a mixture of isomers.

The Mannich additive is preferably the reaction product obtained by reacting components (a), (b) and (c) in a molar ratio of from 5:1:5 to 0.1:1:0.1, more preferably from 3:1:3 to 0.5:1:0.5.

To form the Mannich additive of the present invention components (a) and (b) are preferably reacted in a molar ratio of from 6:1 to 1:4 (aldehyde:amine), preferably from 4:1 to 1:2, more preferably from 3:1 to 1:1.

In preferred embodiments the molar ratio of component (a) to component (b) (aldehyde:amine) in the reaction mixture is preferably greater than 1:1, preferably at least 1.1:1, more preferably at least 1.3:1, suitably at least 1.5:1, for example at least 1.6:1.

Preferably, the molar ratio of component (a) to component (b) (aldehyde:amine) in the reaction mixture is less than 3:1, preferably up to 2.7:1, more preferably up to 2.3:1, for example up to 2.1:1, or up to 2:1.

Preferably, the molar ratio of component (a) to component (b) (aldehyde:amine) in the reaction mixture used to prepare the Mannich additive of the present invention is from 1.1:1 to 2.9:1, preferably from 1.3:1 to 2.7:1, preferably from 1.4:1 to 2.5:1, more preferably from 1.5:1 to 2.3:1, suitably from 1.6:1 to 2.2:1, for example from 1.7:1 to 2.1:1.

To form a preferred Mannich additive of the present invention the molar ratio of component (a) to component (c) (aldehyde:phenol) in the reaction mixture is preferably from 5:1 to 1:4, preferably from 3:1 to 1:2, for example from 2:1 to 1:1.

In preferred embodiments the molar ratio of component (a) to component (c) (aldehyde:phenol) in the reaction mixture used to prepare the Mannich additive of the present invention is greater than 1:1; preferably at least 1.1:1; preferably at least 1.2:1 and more preferably at least 1.3:1.

Preferably the molar ratio of component (a) to component (c) (aldehyde:phenol) is less than 2:1, preferably up to 1.9:1; more preferably up to 1.8:1 for example up to 1.7:1; more preferably up to 1.6:1.

Suitably the molar ratio of component (a) to component (c) (aldehyde:phenol) in the reaction mixture used to prepare the Mannich additive is from 1.05:1 to 1.95:1, preferably from 1.1:1 to 1.85:1, more preferably from 1.2:1 to 1.75:1, suitably from 1.25:1 to 1.65, most preferably from 1.3:1 to 1.55:1.

To form the Mannich additive of the present invention components (c) and (b) are preferably reacted in a molar ratio of from 6:1 to 1:4 (phenol:amine), preferably from 4:1 to 1:2, more preferably from 3:1 to 1:2 and more preferably from 2:1 to 1:2.

Suitably the molar ratio of component (c) to component (b) (phenol:amine) in the reaction mixture is 0.7:1 to 1.9:1, preferably 0.8:1 to 1.8:1, preferably 0.9:1 to 1.7:1, preferably 1:1 to 1.6:1 preferably 1.1:1 to 1.5:1, preferably 1.2:1 to 1.4:1.

In preferred embodiments, the molar ratio of component (c) to component (b) (phenol:amine) in the reaction mixture is greater than 0.5:1; preferably at least 0.8:1; preferably at least 0.9:1 and more preferably at least 1:1 for example at least 1.1:1.

Preferably the molar ratio of component (c) to component (b) (phenol:amine) in the reaction mixture is less than 2:1, preferably up to 1.9:1; more preferably up to 1.7:1 for example up to 1.6:1; more preferably up to 1.5:1.

In some preferred embodiments in the Mannich reaction used to form the additive the molar ratio of component (a) to component (b) is 2.2-1.01:1; the molar ratio of component (a) to component (c) is 1.99-1.01:1 and the molar ratio of component (b) to component (c) is 1:1.01-1.99.

In some preferred embodiments in the reaction used to make the Mannich additive the molar ratio of component (a) to component (b) is 2-1.6:1, the molar ratio of component (a) to component (c) is 1.6-1.2:1 and the molar ratio of component (b) to component (c) is 1:1.1-1.5.

Some preferred compounds used in the present invention are typically formed by reacting components (a), (b) and (c) in a molar ratio of 1.8 parts (a)±0.3 parts (a), to 1 part (b), to 1.3 parts (c)±0.3 parts (c); preferably 1.8 parts (a)±0.1 parts (a), to 1 part (b), to 1.3 parts (c)±0.1 parts (c); preferably approximately 1.8:1:1.3 (a:b:c).

Suitable treat rates of the quaternary ammonium salt additive and when present the Mannich additive will depend on the desired performance and on the type of engine in which they are used. For example different levels of additive may be needed to achieve different levels of performance.

Suitably the quaternary ammonium salt additive is present in the diesel fuel composition in an amount of from 1 to 10000 ppm, preferably from 1 to 1000 ppm, more preferably from 5 to 500 ppm, suitably from 5 to 250 ppm, for example from 5 to 150 ppm.

Suitably the Mannich additive when used is present in the diesel fuel composition in an amount of from 1 to 10000 ppm, preferably from 1 to 1000 ppm, more preferably from 5 to 500 ppm, suitably from 5 to 250 ppm, for example from 5 to 150 ppm.

The weight ratio of the quaternary ammonium salt additive to the Mannich additive is preferably from 1:10 to 10:1, preferably from 1:4 to 4:1, for example from 1:3 to 3:1.

As stated previously, fuels containing biodiesel or metals are known to cause fouling. Severe fuels, for example those containing high levels of metals and/or high levels of biodiesel may require higher treat rates of the quaternary ammonium salt additive and/or Mannich additive than fuels which are less severe.

The diesel fuel composition of the present invention may include one or more further additives such as those which are commonly found in diesel fuels. These include, for example, antioxidants, dispersants, detergents, metal deactivating compounds, wax anti-settling agents, cold flow improvers, cetane improvers, dehazers, stabilisers, demulsifiers, anti-foams, corrosion inhibitors, lubricity improvers, dyes, markers, combustion improvers, metal deactivators, odour masks, drag reducers and conductivity improvers. Examples of suitable amounts of each of these types of additives will be known to the person skilled in the art.

In some preferred embodiments the composition additionally comprises a detergent of the type formed by the reaction of a polyisobutene-substituted succinic acid-derived acylating agent and a polyethylene polyamine. Suitable compounds are, for example, described in WO2009/040583.

By diesel fuel we include any fuel suitable for use in a diesel engine, either for road use or non-road use. This includes, but is not limited to, fuels described as diesel, marine diesel, heavy fuel oil, industrial fuel oil etc.

The diesel fuel composition of the present invention may comprise a petroleum-based fuel oil, especially a middle distillate fuel oil. Such distillate fuel oils generally boil within the range of from 110° C. to 500° C., e.g. 150° C. to 400° C. The diesel fuel may comprise atmospheric distillate or vacuum distillate, cracked gas oil, or a blend in any proportion of straight run and refinery streams such as thermally and/or catalytically cracked and hydro-cracked distillates.

The diesel fuel composition of the present invention may comprise Fischer-Tropsch fuels. It may comprise non-renewable Fischer-Tropsch fuels such as those described as GTL (gas-to-liquid) fuels, CTL (coal-to-liquid) fuels and OTL (oil sands-to-liquid).

The diesel fuel composition of the present invention may comprise a renewable fuel such as a biofuel composition or biodiesel composition.

The diesel fuel composition may comprise 1st generation biodiesel. First generation biodiesel contains esters of, for example, vegetable oils, animal fats and used cooking fats. This form of biodiesel may be obtained by transesterification of oils, for example rapeseed oil, soybean oil, safflower oil, palm 25 oil, corn oil, peanut oil, cotton seed oil, tallow, coconut oil, physic nut oil (Jatropha), sunflower seed oil, used cooking oils, hydrogenated vegetable oils or any mixture thereof, with an alcohol, usually a monoalcohol, in the presence of a catalyst.

The diesel fuel composition may comprise second generation biodiesel. Second generation biodiesel is derived from renewable resources such as vegetable oils and animal fats and processed, often in the refinery, often using hydroprocessing such as the H-Bio process developed by Petrobras. Second generation biodiesel may be similar in properties and quality to petroleum based fuel oil streams, for example renewable diesel produced from vegetable oils, animal fats etc. and marketed by ConocoPhillips as Renewable Diesel and by Neste as NExBTL.

The diesel fuel composition of the present invention may comprise third generation biodiesel. Third generation biodiesel utilises gasification and Fischer-Tropsch technology including those described as BTL (biomass-to-liquid) fuels. Third generation biodiesel does not differ widely from some second generation biodiesel, but aims to exploit the whole plant (biomass) and thereby widens the feedstock base.

The diesel fuel composition may contain blends of any or all of the above diesel fuel compositions.

In some preferred embodiments the diesel fuel composition comprises a Fischer Tropsch fuel and/or biodiesel.

In some embodiments the diesel fuel composition of the present invention may be a blended diesel fuel comprising bio-diesel. In such blends the bio-diesel may be present in an amount of, for example up to 0.5%, up to 1%, up to 2%, up to 3%, up to 4%, up to 5%, up to 10%, up to 20%, up to 30%, up to 40%, up to 50%, up to 60%, up to 70%, up to 80%, up to 90%, up to 95% or up to 99%.

In some embodiments the diesel fuel composition may comprise a secondary fuel, for example ethanol. Preferably however the diesel fuel composition does not contain ethanol.

The diesel fuel composition of the present invention may contain a relatively high sulphur content, for example greater than 0.05% by weight, such as 0.1% or 0.2%.

However in preferred embodiments the diesel fuel has a sulphur content of at most 0.05% by weight, more preferably of at most 0.035% by weight, especially of at most 0.015%. Fuels with even lower levels of sulphur are also suitable such as, fuels with less than 50 ppm sulphur by weight, preferably less than 20 ppm, for example 10 ppm or less.

Commonly when present, metal-containing species will be present as a contaminant, for example through the corrosion of metal and metal oxide surfaces by acidic species present in the fuel or from lubricating oil. In use, fuels such as diesel fuels routinely come into contact with metal surfaces for example, in vehicle fuelling systems, fuel tanks, fuel transportation means etc. Typically, metal-containing contamination may comprise transition metals such as zinc, iron and copper; group I or group II metals such as sodium; and other metals such as lead.

In addition to metal-containing contamination which may be present in diesel fuels there are circumstances where metal-containing species may deliberately be added to the fuel. For example, as is known in the art, metal-containing fuel-borne catalyst species may be added to aid with the regeneration of particulate traps. Such catalysts are often based on metals such as iron, cerium, Group I and Group II metals e.g., calcium and strontium, either as mixtures or alone. Also used are platinum and manganese. The presence of such catalysts may also give rise to injector deposits when the fuels are used in diesel engines having high pressure fuel systems.

Metal-containing contamination, depending on its source, may be in the form of insoluble particulates or soluble compounds or complexes. Metal-containing fuel-borne catalysts are often soluble compounds or complexes or colloidal species.

In some embodiments, the metal-containing species comprises a fuel-borne catalyst.

In some embodiments, the metal-containing species comprises zinc.

In one preferred embodiment the diesel fuel composition of the invention comprises a fuel-borne catalyst which includes a metal selected from iron, cerium, group I and group II metals, platinum, manganese and mixtures thereof. Preferred group I and group II metals include calcium and strontium.

Typically, the amount of metal-containing species in the diesel fuel, expressed in terms of the total weight of metal in the species, is between 0.1 and 50 ppm by weight, for example between 0.1 and 10 ppm by weight, based on the weight of the diesel fuel.

The fuel compositions of the present invention show improved performance when used in diesel engines having high pressure fuel systems compared with diesel fuels of the prior art.

According to a second aspect of the present invention there is provided an additive package which upon addition to a diesel fuel provides a composition of the first aspect.

The additive package may comprise a mixture of the quaternary ammonium salt additive, the Mannich additive and optionally further additives, for example those described above. Alternatively the additive package may comprise a solution of additives, suitably in a mixture of hydrocarbon solvents for example aliphatic and/or aromatic solvents; and/or oxygenated solvents for example alcohols and/or ethers.

According to a third aspect of the present invention there is provided a method of operating a diesel engine, the method comprising combusting in the engine a composition of the first aspect.

According to a fourth aspect of the present invention there is provided the use of a quaternary ammonium salt additive as defined herein in a diesel fuel composition to improve the engine performance of a diesel engine when using said diesel fuel composition.

Preferred features of the second, third and fourth aspects are as defined in relation to the first aspect.

The improvement in performance may be achieved by the reduction or the prevention of the formation of deposits in a diesel engine. This may be regarded as an improvement in "keep clean" performance. Thus the present invention may provide a method of reducing or preventing the formation of deposits in a diesel engine by combusting in said engine a composition of the first aspect.

The improvement in performance may be achieved by the removal of existing deposits in a diesel engine. This may be regarded as an improvement in "clean up" performance. Thus the present invention may provide a method of removing deposits from a diesel engine by combusting in said engine a composition of the first aspect.

In especially preferred embodiments the composition of the first aspect of the present invention may be used to provide an improvement in "keep clean" and "clean up" performance.

In some preferred embodiments the use of the third aspect may relate to the use of a quaternary ammonium salt additive, optionally in combination with a Mannich additive, in a diesel fuel composition to improve the engine performance of a diesel engine when using said diesel fuel composition wherein the diesel engine has a high pressure fuel system.

Modern diesel engines having a high pressure fuel system may be characterised in a number of ways. Such engines are typically equipped with fuel injectors having a plurality of apertures, each aperture having an inlet and an outlet.

Such modern diesel engines may be characterised by apertures which are tapered such that the inlet diameter of the spray-holes is greater than the outlet diameter.

Such modern engines may be characterised by apertures having an outlet diameter of less than 500 μm, preferably less than 200 μm, more preferably less than 150 μm, preferably less than 100 μm, most preferably less than 80 μm or less.

Such modern diesel engines may be characterised by apertures where an inner edge of the inlet is rounded.

Such modern diesel engines may be characterised by the injector having more than one aperture, suitably more than 2 apertures, preferably more than 4 apertures, for example 6 or more apertures.

Such modern diesel engines may be characterised by an operating tip temperature in excess of 250° C.

Such modern diesel engines may be characterised by a fuel pressure of more than 1350 bar, preferably more than 1500 bar, more preferably more than 2000 bar.

The use of the present invention preferably improves the performance of an engine having one or more of the above-described characteristics.

The present invention is particularly useful in the prevention or reduction or removal of deposits on injectors of engines operating at high pressures and temperatures in which fuel may be recirculated and which comprise a plurality of fine apertures through which the fuel is delivered to the engine. The present invention finds utility in engines for heavy duty vehicles and passenger vehicles. Passenger vehicles incorporating a high speed direct injection (or HSDI) engine may for example benefit from the present invention.

Within the injector body of modern diesel engines having a high pressure fuel system, clearances of only 1-2 μm may exist between moving parts and there have been reports of engine problems in the field caused by injectors sticking and particularly injectors sticking open. Control of deposits in this area can be very important.

The diesel fuel compositions of the present invention may also provide improved performance when used with traditional diesel engines. Preferably the improved performance is achieved when using the diesel fuel compositions in modern diesel engines having high pressure fuel systems and when using the compositions in traditional diesel engines. This is important because it allows a single fuel to be provided that can be used in new engines and older vehicles.

The improvement in performance of the diesel engine system may be measured by a number of ways. Suitable methods will depend on the type of engine and whether "keep clean" and/or "clean up" performance is measured.

One of the ways in which the improvement in performance can be measured is by measuring the power loss in a controlled engine test. An improvement in "keep clean" performance may be measured by observing a reduction in power loss compared to that seen in a base fuel.

"Clean up" performance can be observed by an increase in power when diesel fuel compositions of the invention are used in an already fouled engine.

The improvement in performance of the diesel engine having a high pressure fuel system may be measured by an improvement in fuel economy.

The use of the third aspect may also improve the performance of the engine by reducing, preventing or removing deposits in the vehicle fuel filter.

The level of deposits in a vehicle fuel filter may be measured quantitatively or qualitatively. In some cases this may only be determined by inspection of the filter once the filter has been removed. In other cases, the level of deposits may be estimated during use. Many vehicles are fitted with a fuel filter which may be visually inspected during use to determine the level of solids build up and the need for filter replacement. For example, one such system uses a filter canister within a transparent housing allowing the filter, the fuel level within the filter and the degree of filter blocking to be observed.

Using the fuel compositions of the present invention may result in levels of deposits in the fuel filter which are considerably reduced compared with fuel compositions not of the present invention. This allows the filter to be changed much less frequently and can ensure that fuel filters do not fail between service intervals. Thus the use of the compositions of the present invention may lead to reduced maintenance costs.

In some embodiments the occurrence of deposits in a fuel filter may be inhibited or reduced. Thus a "keep clean" performance may be observed. In some embodiments existing deposits may be removed from a fuel filter. Thus a "clean up" performance may be observed.

Improvement in performance may also be assessed by considering the extent to which the use of the fuel compositions of the invention reduce the amount of deposit on the injector of an engine. For "keep clean" performance a reduction in occurrence of deposits would be observed. For "clean up" performance removal of existing deposits would be observed.

Direct measurement of deposit build up is not usually undertaken, but is usually inferred from the power loss or fuel flow rates through the injector.

The use of the third aspect may improve the performance of the engine by reducing, preventing or removing deposits including gums and lacquers within the injector body.

In Europe the Co-ordinating European Council for the development of performance tests for transportation fuels, lubricants and other fluids (the industry body known as CEC), has developed a new test, named CEC F-98-08, to assess whether diesel fuel is suitable for use in engines meeting new European Union emissions regulations known as the "Euro 5" regulations. The test is based on a Peugeot DW10 engine using Euro 5 injectors, and will hereinafter be referred to as the DW10 test. It will be further described in the context of the examples (see example 5).

Preferably the use of the fuel composition of the present invention leads to reduced deposits in the DW10 test. For "keep clean" performance a reduction in the occurrence of deposits is preferably observed. For "clean up" performance removal of deposits is preferably observed.

The DW10 test is used to measure the power loss in modern diesel engines having a high pressure fuel system.

For older engines an improvement in performance may be measured using the XUD9 test. This test is described in relation to example 4.

Suitably the use of a fuel composition of the present invention may provide a "keep clean" performance in modern diesel engines, that is the formation of deposits on the injectors of these engines may be inhibited or prevented. Preferably this performance is such that a power loss of less than 5%, preferably less than 2% is observed after 32 hours as measured by the DW10 test.

Suitably the use of a fuel composition of the present invention may provide a "clean up" performance in modern diesel engines, that is deposits on the injectors of an already fouled engine may be removed. Preferably this performance is such that the power of a fouled engine may be returned to within 1% of the level achieved when using clean injectors within 32 hours as measured in the DW10 test.

Preferably rapid "clean-up" may be achieved in which the power is returned to within 1% of the level observed using clean injectors within 10 hours, preferably within 8 hours, suitably within 6 hours, preferably within 4 hours, more preferably within 2 hours.

Clean injectors can include new injectors or injectors which have been removed and physically cleaned, for example in an ultrasound bath.

Suitably the use of a fuel composition of the present invention may provide a "keep clean" performance in traditional diesel engines, that is the formation of deposits on the injectors of these engines may be inhibited or prevented. Preferably this performance is such that a flow loss of less than 50%, preferably less than 30% is observed after 10 hours as measured by the XUD-9 test.

Suitably the use of a fuel composition of the present invention may provide a "clean up" performance in traditional diesel engines, that is deposits on the injectors of an already fouled engine may be removed. Preferably this performance is such that the flow loss of a fouled engine may be increased by 10% or more within 10 hours as measured in the XUD-9 test.

Any feature of any aspect of the invention may be combined with any other feature, where appropriate.

The invention will now be further defined with reference to the following non-limiting examples.

EXAMPLE 1

A 1 litre reaction flask was charged with poly(ethylene glycol), $PEG_{600}$ (92.91 g, 155 mmol) and polyisobutylene succinic anhydride prepared using 1000MW PIB (390.18 g, 308 mmol) then heated to 110° C. for 16 hours.

A reaction flask was charged with 157.05 g (105.2 mmol H+) of the product described above and toluene (115.27 g) then heated to 40° C. under $N_2$. Thionyl chloride (20.38 g, 171 mmol) was charged to a dropping funnel and added slowly to the reaction flask. The temperature increased over the course of the addition to 75° C. Toluene was removed by distillation at 110° C. and the product cooled to ambient. Pyridine (12.5 g, 158 mmol) was added in three aliquots. A dropping funnel was charged with N,N-dimethylaminopropyl amine (10.71 g, 105 mmol) and added dropwise to the reaction flask then heated to reflux for 1 hour. The product was added to a separating funnel containing diethyl ether, water and 5 wt % aqueous NaOH. The organic phase was separated and solvent removed under vacuum.

38.54 g of the above product (25.5 mmol) was charged to a reaction flask and methyl salicylate (3.73 g, 24.5 mmol) added. The contents were heated to 138° C. for 16 hours. Caromax 20 (28.28 g) was added and the mixture cooled.

EXAMPLE 2

A 1 litre reactor was charged with polyisobutene (478 g, 0.637 mol) and heated 195° C. under $N_2$. Maleic anhydride (137.41 g, 2.2 mol eq.) was added over 2 hours then held at 195° C. for 2 hours. The temperature was increased to 205° C. for 18 hours then excess maleic anhydride removed under vacuum.

98.87 g of the above product was charged to a reaction flask and heated to 90° C. Dimethylaminopropylamine (15.47 g, 0.15 mol) was added over 1 hour then refluxed at 160° C. for 5 hours and water of reaction was removed. Methyl salicylate (22.82 g, 0.15 mol) was added and refluxed at 140° C. for 24 hours. The product was cooled and 2-ethyl hexanol (89.5 g) added.

EXAMPLE 3

Comparative

A reactor was charged with 33.2 kg (26.5 mol) PIBSA (made from 1000MW PIB and maleic anhydride) and heated to 90° C. DMAPA (2.71 kg, 26.5 mol) was charged and the mixture stirred for 1 hour at 90-100° C. The temperature was increased to 140° C. for 3 hours and water removed. Methyl salicylate (4.04 kg, 26.5 mol) was charged and the mixture held at 140° C. for 8 hours. Caromax 20 (26.6 kg) was added.

EXAMPLE 4

The effectiveness of the additives of the present invention in older engine types were assessed using a standard industry test—CEC test method No. CEC F-23-A-01.

This test measures injector nozzle coking using a Peugeot XUD9 A/L Engine and provides a means of discriminating between fuels of different injector nozzle coking propensity. Nozzle coking is the result of carbon deposits forming between the injector needle and the needle seat. Deposition of the carbon deposit is due to exposure of the injector needle and seat to combustion gases, potentially causing undesirable variations in engine performance.

The Peugeot XUD9 A/L engine is a 4 cylinder indirect injection Diesel engine of 1.9 litre swept volume, obtained from Peugeot Citroen Motors specifically for the CEC PF023 method.

The test engine is fitted with cleaned injectors utilising unflatted injector needles. The airflow at various needle lift positions have been measured on a flow rig prior to test. The engine is operated for a period of 10 hours under cyclic conditions.

| Stage | Time (secs) | Speed (rpm) | Torque (Nm) |
|---|---|---|---|
| 1 | 30 | 1200 ± 30 | 10 ± 2 |
| 2 | 60 | 3000 ± 30 | 50 ± 2 |
| 3 | 60 | 1300 ± 30 | 35 ± 2 |
| 4 | 120 | 1850 ± 30 | 50 ± 2 |

The propensity of the fuel to promote deposit formation on the fuel injectors is determined by measuring the injector nozzle airflow again at the end of test, and comparing these values to those before test. The results are expressed in terms of percentage airflow reduction at various needle lift positions for all nozzles. The average value of the airflow reduction at 0.1 mm needle lift of all four nozzles is deemed the level of injector coking for a given fuel.

Diesel fuel compositions were prepared by adding additives to aliquots all drawn from a common batch of RF06 base fuel, and containing 1 ppm zinc (as zinc neodecanoate). In each case 80 ppm of the crude additive prepared as described in examples 1, 2 and 3 was used. The results are shown in table 1:

TABLE 1

| | Treat rate, mg/kg | % Flow Loss |
|---|---|---|
| Example 1 | 80 | 0.8 |
| Example 2 | 80 | 0.3 |
| Comparative example 3 | 80 | 22.8 |

Table 2 below shows the specification for RF06 base fuel.

TABLE 2

| | | Limits | | |
|---|---|---|---|---|
| Property | Units | Min | Max | Method |
| Cetane Number | | 52.0 | 54.0 | EN ISO 5165 |
| Density at 15° C. | kg/m$^3$ | 833 | 837 | EN ISO 3675 |
| Distillation | | | | |
| 50% v/v Point | ° C. | 245 | — | |
| 95% v/v Point | ° C. | 345 | 350 | |
| FBP | ° C. | — | 370 | |
| Flash Point | ° C. | 55 | — | EN 22719 |
| Cold Filter Plugging Point | ° C. | — | −5 | EN 116 |
| Viscosity at 40° C. | mm$^2$/sec | 2.3 | 3.3 | EN ISO 3104 |
| Polycyclic Aromatic Hydrocarbons | % m/m | 3.0 | 6.0 | IP 391 |
| Sulphur Content | mg/kg | — | 10 | ASTM D 5453 |
| Copper Corrosion | | — | 1 | EN ISO 2160 |

TABLE 2-continued

| | | Limits | | |
|---|---|---|---|---|
| Property | Units | Min | Max | Method |
| Conradson Carbon Residue on 10% Dist. Residue | % m/m | — | 0.2 | EN ISO 10370 |
| Ash Content | % m/m | — | 0.01 | EN ISO 6245 |
| Water Content | % m/m | — | 0.02 | EN ISO 12937 |
| Neutralisation (Strong Acid) Number | mg KOH/g | — | 0.02 | ASTM D 974 |
| Oxidation Stability | mg/mL | — | 0.025 | EN ISO 12205 |
| HFRR (WSD1,4) | µm | — | 400 | CEC F-06-A-96 |
| Fatty Acid Methyl Ester | | | prohibited | |

EXAMPLE 5

The performance of diesel fuel compositions of the present invention in modern diesel engines may be tested according to the CECF-98-08 DW 10 method.

The engine of the injector fouling test is the PSA DW10BTED4. In summary, the engine characteristics are:

Design: Four cylinders in line, overhead camshaft, turbocharged with EGR

Capacity: 1998 cm$^3$

Combustion chamber Four valves, bowl in piston, wall guided direct injection

Power: 100 kW at 4000 rpm

Torque: 320 Nm at 2000 rpm

Injection system: Common rail with piezo electronically controlled 6-hole injectors.

Max. pressure: 1600 bar ($1.6\times10^8$ Pa). Proprietary design by SIEMENS VDO

Emissions control: Conforms with Euro IV limit values when combined with exhaust gas post-treatment system (DPF)

This engine was chosen as a design representative of the modern European high-speed direct injection diesel engine capable of conforming to present and future European emissions requirements. The common rail injection system uses a highly efficient nozzle design with rounded inlet edges and conical spray holes for optimal hydraulic flow. This type of nozzle, when combined with high fuel pressure has allowed advances to be achieved in combustion efficiency, reduced noise and reduced fuel consumption, but are sensitive to influences that can disturb the fuel flow, such as deposit formation in the spray holes. The presence of these deposits causes a significant loss of engine power and increased raw emissions.

The test is run with a future injector design representative of anticipated Euro V injector technology. It is considered necessary to establish a reliable baseline of injector condition before beginning fouling tests, so a sixteen hour running-in schedule for the test injectors is specified, using non-fouling reference fuel.

Full details of the CEC F-98-08 test method can be obtained from the CEC. The coking cycle is summarized below.

1. A warm up cycle (12 minutes) according to the following regime:

| Step | Duration (minutes) | Engine Speed (rpm) | Torque (Nm) |
|---|---|---|---|
| 1 | 2 | idle | <5 |
| 2 | 3 | 2000 | 50 |
| 3 | 4 | 3500 | 75 |
| 4 | 3 | 4000 | 100 |

2. 8 hrs of engine operation consisting of 8 repeats of the following cycle

| Step | Duration (minutes) | Engine Speed (rpm) | Load (%) | Torque (Nm) | Boost Air After IC (° C.) |
|---|---|---|---|---|---|
| 1 | 2 | 1750 | (20) | 62 | 45 |
| 2 | 7 | 3000 | (60) | 173 | 50 |
| 3 | 2 | 1750 | (20) | 62 | 45 |
| 4 | 7 | 3500 | (80) | 212 | 50 |
| 5 | 2 | 1750 | (20) | 62 | 45 |
| 6 | 10 | 4000 | 100 | * | 50 |
| 7 | 2 | 1250 | (10) | 20 | 43 |
| 8 | 7 | 3000 | 100 | * | 50 |
| 9 | 2 | 1250 | (10) | 20 | 43 |
| 10 | 10 | 2000 | 100 | * | 50 |
| 11 | 2 | 1250 | (10) | 20 | 43 |
| 12 | 7 | 4000 | 100 | * | 50 |

* for expected range see CEC method CEC-F-98-08

3. Cool down to idle in 60 seconds and idle for 10 seconds
4. 4 hrs soak period

The standard CEC F-98-08 test method consists of 32 hours engine operation corresponding to 4 repeats of steps 1-3 above, and 3 repeats of step 4. ie 56 hours total test time excluding warm ups and cool downs.

The invention claimed is:

1. A diesel fuel composition comprising a quaternary ammonium salt additive which additive is formed by the reaction of (1) a quaternising agent and (2) a compound formed by the reaction of a hydrocarbyl-substituted acylating agent and at least 1.7 molar equivalents of an amine of formula (B1) or (B2):

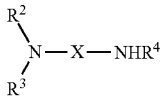

(B1)

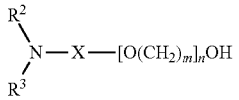

(B2)

wherein $R^2$ and $R^3$ are the same or different alkyl, alkenyl or aryl groups having from 1 to 22 carbon atoms; X is a bond or alkylene group having from 1 to 20 carbon atoms; n is from 0 to 20; m is from 1 to 5; and $R^4$ is hydrogen or a $C_1$ to $C_{22}$ alkyl group;

wherein to form the quaternary ammonium salt additive approximately one molar equivalent of the quaternizing agent (1) will be used for each tertiary amine group present in compound (2).

2. The diesel fuel composition according to claim 1 wherein the amine of formula (B1) or (B2) is not N,N-dimethyl-2-ethanolamine or 2-(2-dimethylaminoethoxy)ethanol.

3. The diesel fuel composition according to any preceding claim 1 wherein the quaternising agent is an ester of formula $RCOOR^1$ in which R is an optionally substituted alkyl, alkenyl, aryl or alkylaryl group and $R^1$ is a $C_1$ to $C_{22}$ alkyl, aryl or alkylaryl group.

4. The diesel fuel composition according to claim 1 wherein the quaternising agent is selected from dialkyl sulfates, benzyl halides, hydrocarbyl substituted carbonates, hydrocarbyl substituted epoxides in combination with an acid, alkyl halides, alkyl sulfonates, sultones, hydrocarbyl substituted phosphates, hydrocarbyl substituted borates, alkyl nitrites, alkyl nitrates, N-oxides or mixtures thereof.

5. The diesel fuel composition according to claim 1 wherein the quaternising agent is selected from dimethyl oxalate, methyl 2-nitrobenzoate, methyl salicylate and styrene oxide or propylene oxide optionally in combination with an additional acid.

6. The diesel fuel composition according to claim 1 wherein the hydrocarbyl substituted acylating agent is reacted with a diamine compound of formula (B1).

7. The diesel fuel composition according to claim 1 wherein the hydrocarbyl substituted acylating agent comprises two carboxylic acid groups spaced by at least three carbon atoms between the carbon atoms which form part of the acid group.

8. The diesel fuel composition according to claim 1 which further comprises a second additive which is the product of a Mannich reaction between:

(a) an aldehyde;

(b) an amine; and (c) an optionally substituted phenol.

9. The diesel fuel composition according to claim 8 wherein phenol component (c) used to prepare the Mannich additive is substituted with at least one branched hydrocarbyl group having a molecular weight of between 200 and 3000.

10. The diesel fuel composition according to claim 8 wherein embodiments the or each substituent of the phenol component (c) used to prepare the Mannich additive has an average molecular weight of less than 400.

11. The diesel fuel composition according to claim 8 wherein in the Mannich reaction used to form additive the molar ratio of component (a) to component (b) is 2.2-1.01:1; the molar ratio of component (a) to component (c) is 1.99-1.01:1 and the molar ratio of component (b) to component (c) is 1:1.01-1.99.

12. The diesel fuel composition according to claim 1 wherein the diesel fuel comprises a Fischer Tropsch fuel and/or biodiesel.

13. An additive package which upon addition to a diesel fuel provides a composition as claimed in claim 1.

14. A method of operating a diesel engine, the method comprising combusting in the engine a composition as claimed in claim 1.

* * * * *